US009783902B2

(12) United States Patent
Takamizawa et al.

(10) Patent No.: US 9,783,902 B2
(45) Date of Patent: Oct. 10, 2017

(54) METHOD FOR PRODUCING PLATED ARTICLE

(71) Applicant: OM Sangyo Co., Ltd., Okayama-shi, Okayama (JP)

(72) Inventors: Masao Takamizawa, Kurashiki (JP); Yoshiyuki Nishimura, Kurashiki (JP); Chisa Fukuda, Okayama (JP)

(73) Assignee: OM SANGYO CO., LTD., Okayama-shi, Okayama (JP)

( * ) Notice: Subject to any disclaimer, the term of this patent is extended or adjusted under 35 U.S.C. 154(b) by 0 days.

(21) Appl. No.: 14/894,068

(22) PCT Filed: Oct. 24, 2014

(86) PCT No.: PCT/JP2014/078412
§ 371 (c)(1),
(2) Date: Nov. 25, 2015

(87) PCT Pub. No.: WO2015/060449
PCT Pub. Date: Apr. 30, 2015

(65) Prior Publication Data

US 2016/0102412 A1 Apr. 14, 2016

(30) Foreign Application Priority Data

Oct. 25, 2013 (JP) ..... 2013-222186

(51) Int. Cl.
*C25D 3/12* (2006.01)
*C25D 3/56* (2006.01)
(Continued)

(52) U.S. Cl.
CPC ..... *C25D 3/12* (2013.01); *C23C 18/1653* (2013.01); *C25D 3/562* (2013.01); *C25D 5/16* (2013.01); *C25D 7/123* (2013.01); *C25D 21/12* (2013.01)

(58) Field of Classification Search
CPC ..... C25D 3/12; C25D 3/562
(Continued)

(56) References Cited

U.S. PATENT DOCUMENTS 4,916,098 A 4/1990 Ménard et al.
2004/0188267 A1* 9/2004 Sakamoto ..... C25D 3/12 205/181
(Continued)

FOREIGN PATENT DOCUMENTS

GB 593763 A 10/1947
GB 1 603 471 11/1981
(Continued)

OTHER PUBLICATIONS

Rafailovic et al, "Study of the Dendritic Growth of Ni—Co Alloys Electrodeposited on Cu Substrates" Journal of the Electrochemical Society, 157, (5), D295-D301, 2010.*
(Continued)

*Primary Examiner* — Brian W Cohen
(74) *Attorney, Agent, or Firm* — Buchanan, Ingersoll & Rooney PC

(57) ABSTRACT

There is provided a method for producing a plated article, comprising immersing a substrate made of a conductive metal in a plating solution and forming a plating layer on the substrate by electroplating, wherein the plating solution is a solution containing 0.01 to 1 mol/L of Ni ions with pH of 6 or more; and a porous Ni plating layer is formed by performing the electroplating at a cathode current density of 10 A/dm$^2$ or more. This method allows for easily producing a plated article wherein a uniform porous Ni plating layer is formed on the surface of a substrate.

7 Claims, 2 Drawing Sheets

(51) Int. Cl.

| | |
|---|---|
| ***C25D 5/12*** | (2006.01) |
| ***C25D 5/16*** | (2006.01) |
| ***C25D 7/12*** | (2006.01) |
| ***C25D 21/12*** | (2006.01) |
| ***C23C 18/16*** | (2006.01) |

(58) Field of Classification Search
USPC ..... 205/271, 255
See application file for complete search history.

(56) References Cited

U.S. PATENT DOCUMENTS

| | | | | |
|---|---|---|---|---|
| 2010/0116528 | A1 | 5/2010 | Shim et al. | |
| 2010/0126849 | A1* | 5/2010 | Lopatin | H01M 4/0438 204/275.1 |
| 2010/0193365 | A1* | 8/2010 | Lopatin | C25D 3/38 205/111 |
| 2013/0202910 | A1* | 8/2013 | Koppe | C23C 18/1644 428/596 |
| 2013/0321983 | A1* | 12/2013 | Chung | C25D 5/48 361/502 |
| 2015/0090600 | A1* | 4/2015 | Inoue | C25D 3/58 205/162 |

FOREIGN PATENT DOCUMENTS

| | | | | |
|---|---|---|---|---|
| JP | 5-222568 | A | 8/1993 | |
| JP | 2000-204495 | A | 7/2000 | |
| JP | 2007-270236 | A | 10/2007 | |
| JP | 2009-62577 | A | 3/2009 | |
| JP | 2010-118662 | A | 5/2010 | |
| JP | 2010121194 | A | 6/2010 | |
| JP | WO 2013157639 | A1 * | 10/2013 | C25D 3/58 |
| KR | WO 2012093880 | A2 * | 7/2012 | C25D 5/48 |
| WO | 2013/094766 | A1 | 6/2013 | |

OTHER PUBLICATIONS

International Search Report (PCT/ISA/210) dated Jan. 20, 2015, by the Japanese Patent Office as the International Searching Authority for International Application No. PCT/JP2014/078412.

Search Report dated Oct. 28, 2016, by the State Intellectual Property Office of China, in corresponding Chinese Patent Application No. 2014800306119 with an English translation of the Search Report (5 pages).

Xie et al., "Comparison of four nickel-based electrodes for hydrogen evolution reaction," Electrochimica Acta, vol. 88, 2013, pp. 390-394.

The Extended European Search Report dated May 23, 2017, by the European Patent Office in corresponding European Patent Application No. 14856618.5. (8 pages).

* cited by examiner

[Fig.1]
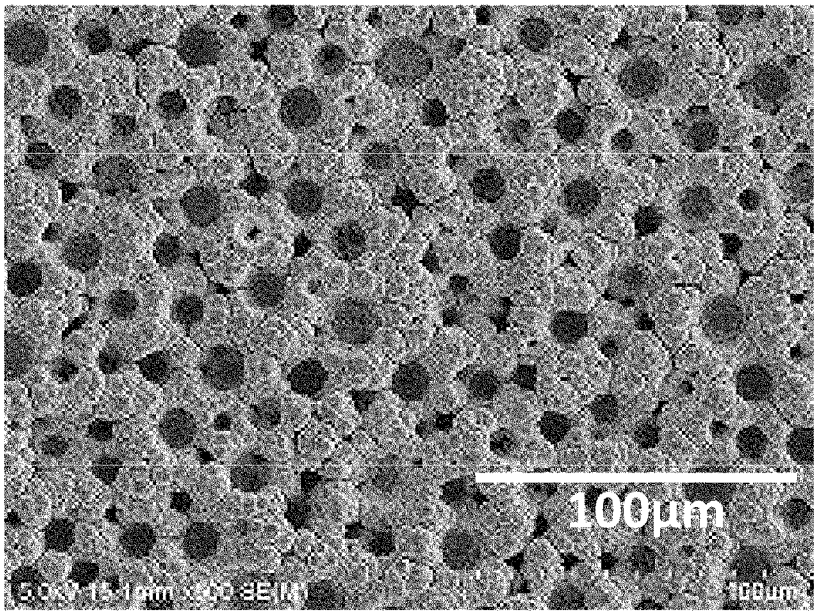
[Fig.2]
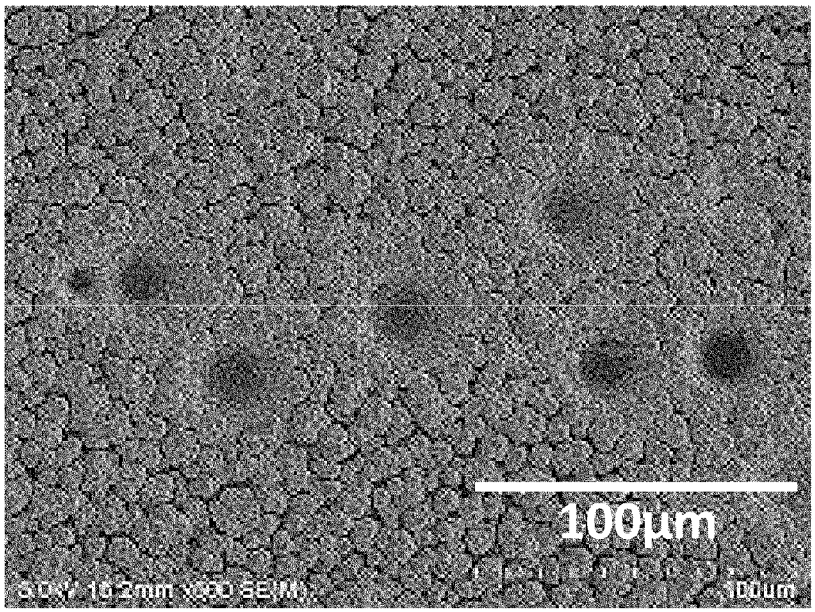

[Fig.3]
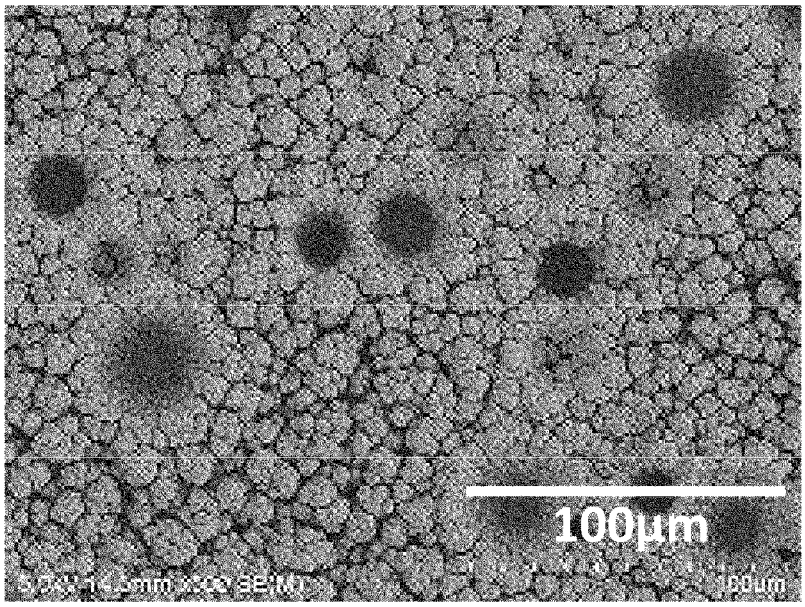
[Fig.4]
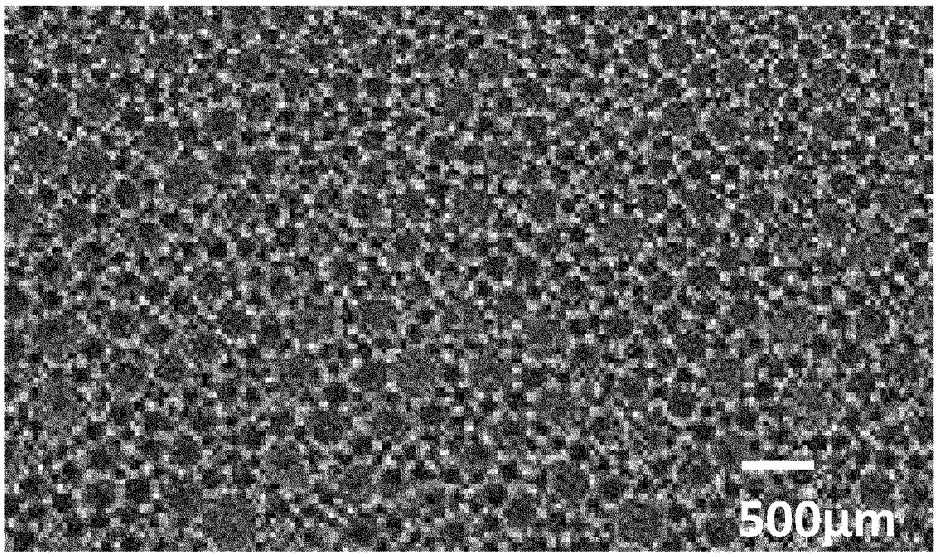

METHOD FOR PRODUCING PLATED ARTICLE

TECHNICAL FIELD

The present invention relates to a method for producing a plated article comprising electroplating a substrate to form a porous Ni plating layer.

BACKGROUND ART

Electric Ni plating is one of surface treatment methods for forming an Ni plating layer on a substrate surface made of a conductive metal, and the Ni plating layer formed exhibits excellent corrosion resistance. Thus, plated articles which are electrically Ni-plated have been extensively used in electronic parts and the like for an automobiles or home electric appliances. In recent years, there have been needed plated articles having further improved electric, mechanic and chemical properties as automobiles and home electric appliances have become highly functional.

It is known that electric, mechanic or chemical properties of a plated article can be further improved by forming a porous Ni plating layer on a substrate surface. Furthermore, a plated article having a porous Ni plating layer can be used as an electric part such as a connector because it exhibits low contact electrical resistance and excellent corrosion resistance and slidability; can be used as an electrode such as an electrode for hydrogen generation because it is very porous and has a large surface area; and can be used as a heat sink because it exhibits good heat dissipation performance. Recently it is, therefore, regarded that technique for forming a porous Ni plating layer on a substrate surface is one of the particularly important techniques.

A method described in Patent Reference No. 1 can be mentioned as an example of a method for forming a porous Ni plating layer on a substrate surface. Patent Reference No. 1 has described a method for forming a porous Ni plating layer on a substrate surface, comprising immersing a substrate in a plating solution containing a quaternary ammonium salt (dodecyltrimethylammonium chloride) and electroplating the substrate. However, the method described in Patent Reference No. 1 requires the use of a plating solution containing a special salt, and is, therefore, not always a simple method.

Patent Reference No. 2 has disclosed that an Ni-plating surface can be roughened for improving adhesiveness to another film. Patent Reference No. 2 has described that a plating solution used for a nickel plating bath for forming a rough plating layer can contain 2.5 to 3.5 g/L of nickel sulfate or nickel chloride, 2.5 to 3.0 g/L of ammonium sulfate, 4.5 to 5.0 g/L of sodium sulfate, 1.5 to 2.0 g/L of sodium chloride, and 2.0 to 3.0 g/L of boric acid. It has also described that by applying a high current density of 10 ASD ($A/dm^2$) or more, a nickel plating layer with large surface roughness can be formed. However, it cannot form a porous Ni plating layer, and thus only roughening the surface cannot improve electric and/or chemical properties of a plated article.

Non-patent Reference No. 1 has described a method for forming a porous Ni plating layer on a substrate surface. Specifically, Non-patent Reference No. 1 has described electric Ni plating using a plating solution containing 0.2 M Ni chloride and 2.0 M ammonium chloride at pH 3.61, where a cathode current density of more than 300 $mA/cm^2$ (30 $A/dm^2$) can form an Ni plating layer having cavities and pores over the whole surface. However, the method described in Non-patent Reference No. 1 cannot form a uniform porous Ni plating layer over the whole surface of a substrate, and it cannot be thus expected to fully improve electric, mechanic or chemical properties of a plated article to be produced.

PRIOR ART REFERENCES

Patent References

Patent Reference No. 1: WO 2013/094766
Patent Reference No. 2: JP 2010-118662A

Non-Patent References

Non-patent Reference No. 1: C. A. Marozzi, A. C. Chialvo, Electrochimica Acta 45 (2000) 2111-2120

SUMMARY OF THE INVENTION

Problem to be Solved by the Invention

To solve the above problems, an objective of the present invention is to provide a method for easily producing a plated article where a uniform porous Ni plating layer is formed on a substrate surface.

Means for Solving Problem

The above problems can be solved by providing a method for producing a plated article, comprising immersing a substrate made of a conductive metal in a plating solution, and forming a plating layer on the substrate by electroplating, wherein the plating solution is a solution containing 0.01 to 1 mol/L of Ni ions with a pH of 6 or more; and a porous Ni plating layer is formed by performing the electroplating at a cathode current density of 10 $A/dm^2$ or more.

Here, it is preferable that the plating solution contains 0.2 to 30 mol/L of ammonia, and a molar ratio of ammonia to Ni ions ($NH_3$/Ni ions) is 1 or more. It is also preferable that the plating solution contains 0.2 to 10 mol/L of at least one type of ions selected from the group consisting of ammonium ions and alkali metal ions. It is also preferable that the plating solution contains, as counter anions to Ni, ammonium and alkali metal ions, at least one type of ions selected from the group consisting of chloride, sulfate, sulfamate and acetate ions.

It is preferable that the plating solution contains 0.01 to 5 g/L of a water-soluble polymer. It is also preferable that the plating solution contains 0.1 to 100 mg/L of a surfactant.

It is preferable that a mean diameter of pores formed in the porous Ni plating layer is 1 to 300 μm as an area weighted average value. It is also preferable that a thickness of the porous Ni plating layer is 1 to 300 μm. It is also preferable that the substrate consists of a conductive metal layer formed on the surface of a nonmetallic or semimetallic material.

Furthermore, a plating solution suitably used in the above producing method is a plating solution, comprising 0.01 to 1 mol/L of Ni ions, 0.2 to 30 mol/L of ammonia, and 0.2 to 10 mol/L of at least one type of ions selected from the group consisting of ammonium ions and alkali metal ions, wherein a molar ratio of ammonia to Ni ions ($NH_3$/Ni ions) is 1 or more and a pH is 6 or more.

Effects of the Invention

According to the producing method of the present invention, a plated article where a uniform porous Ni plating layer is formed on a substrate surface can be easily produced.

BRIEF DESCRIPTION OF THE DRAWINGS

FIG. 1 is a secondary electron image of the surface of the plated article in Example 1.

FIG. 2 is a secondary electron image of the surface of the plated article in Comparative Example 1.

FIG. 3 is a secondary electron image of the surface of the plated article in Comparative Example 3.

FIG. 4 is a microgram of the surface of the plated article in Example 12.

MODES FOR CARRYING OUT THE INVENTION

The present invention relates to a method for producing a plated article, comprising immersing a substrate made of a conductive metal in a plating solution, and forming a plating layer on the substrate by electroplating. After intense investigation, we have found that a uniform porous Ni plating layer can be formed on a substrate surface by immersing a substrate made of a conductive metal in a solution containing 0.01 to 1 mol/L (M) of Ni ions with a pH of 6 or more and performing electroplating at a cathode current density of 10 A/dm$^2$ or more. A uniform porous Ni plating layer can be formed on a substrate surface by performing electric Ni plating on the substrate with a high cathode current density using a plating solution with a high pH. The fact that a uniform porous Ni plating layer can be formed by such an easy method was found first by our investigation and is surprising. "Porous Ni plating layer" as used herein refers to a Ni plating layer having a plurality of pores recessed toward a substrate.

A plating solution used in the present invention contains 0.01 to 1 mol/L of Ni ions. If the content of Ni ions is less than 0.01 mol/L, strength of the porous Ni plating layer is reduced. The content of Ni ions is preferably 0.05 mol/L or more, more preferably 0.1 mol/L or more. Meanwhile, if the content of Ni ions is more than 1 mol/L, a porous Ni plating layer cannot be formed on a substrate surface. The content of Ni ions is preferably 0.8 mol/L or less, more preferably 0.5 mol/L or less. Here, as long as the effects of the present invention are not hampered, the plating solution can contain metal ions other than Ni ions. It is, however, preferable that the plating solution contains 0.01 to 1 mol/L of Ni ions and is substantially free from metal ions other than Ni ions. If metal ions other than Ni ions are contained in the plating solution, corrosion resistance of a Ni plating layer formed may be deteriorated.

A pH of the above plating solution is 6 or more. If a pH of the plating solution is less than 6, a uniform porous Ni plating layer cannot be formed. A pH of the plating solution is preferably 7 or more, more preferably 7.5 or more, further preferably 8 or more. There are no particular restrictions to the upper limit of a pH, and it is generally 14 or less, preferably 12 or less, more preferably 9.5 or less.

A pH of a plating solution can be adjusted to the above range by, but not limited to, adding ammonia; a metal hydroxide such as sodium hydroxide; or a metal carbonate such as sodium hydrogen carbonate to the plating solution. As described above, it is disadvantageous that a plating solution contains metal ions other than Ni ions. By using ammonia for adjusting a pH, contamination of the plating solution with metal ions other than Ni ions can be avoided. In this light, a plating solution is preferably a solution whose pH is adjusted to 6 or more using ammonia. Herein, ammonia does not contain a dissociated entity, that is, ammonium ions. A pH can be adjusted using ammonia, specifically by, but not limited to, adding an aqueous ammonia solution to a plating solution or blowing ammonia gas into a plating solution.

Here, the plating solution preferably contains 0.2 to 30 mol/L of ammonia. Herein, a content of ammonia is an ammonia concentration per one liter of the plating solution calculated from a molar number of ammonia added to the plating solution. If a content of ammonia is less than 0.2 mol/L, a pH of the plating solution may not be adjusted to 6 or more. A content of ammonia is more preferably 0.3 mol/L or more, further preferably 0.5 mol/L or more. If a content of ammonia is more than 30 mol/L, a production cost increases and odor may deteriorate working environment, so that the process may not be industrially feasible. A content of ammonia is more preferably 20 mol/L or less, further preferably 10 mol/L or less.

Furthermore, adding a metal hydroxide such as sodium hydroxide to a plating solution for adjusting a pH may cause precipitation of Ni ions as Ni hydroxide, while adding ammonia to a plating solution does not cause such precipitation. This would be because ammonia coordinates a Ni ion in the plating solution to form an ammine (ammonia) complex. Herein, a molar ratio of ammonia to Ni ions ($NH_3$/Ni ions) in a plating solution is preferably 1 or more. If a molar ratio of ammonia to Ni ions ($NH_3$/Ni ions) is less than 1, the amount of ammonia coordinating Ni ions may be so reduced that ammine complexes cannot be formed. A molar ratio of ammonia to Ni ions ($NH_3$/Ni ions) is more preferably 2 or more, further preferably 4 or more. There are no particular restrictions to the upper limit of a molar ratio of ammonia to Ni ions ($NH_3$/Ni ions), but if the molar ratio is excessively large, ammonia uninvolved in coordination to a Ni ion may be excessive, leading to disadvantage in cost and deteriorated working atmosphere. A molar ratio of ammonia to Ni ions ($NH_3$/Ni ions) is generally 30 or less.

A plating solution preferably contains 0.2 to 10 mol/L of at least one type of ions selected from the group consisting of ammonium ions and alkali metal ions. If a content of the above ions is less than 0.2 mol/L, liquid resistance of the plating solution may be increased, so that when electric Ni plating is conducted at a high current density, a temperature of the plating solution is rapidly elevated, leading to difficulty in continuous production of the plated article. A content of the above ions is more preferably 0.5 mol/L or more. If a plating solution with a content of the above ions of more than 10 mol/L is prepared, a large amount of ammonium salts or alkali metal salts as ion sources of ammonium ions or alkali metal ions must be dissolved, probably leading to increase in a production cost. A content of the above ions is more preferably 5 mol/L or less.

There are no particular restrictions to the type of counter anions to Ni ions, ammonium ions and alkali metal ions. Examples of counter anions can include halide ions such as chloride ions; sulfate ions; sulfamate ions; acetate ions; nitrate ions; and citrate ions. Among others, in the light of availability and a low price, a plating solution preferably contains, as the above counter anions, at least one type of ions selected from the group consisting of chloride, sulfate, sulfamate and acetate ions. The solution more preferably contains chloride ions and/or sulfate ions.

A substrate used in the present invention can be made of any conductive metal without any limitation. Among others, copper or an alloy containing copper as a main component is suitably used in the light of conductive performance and the like. The expression "containing . . . as a main component" as used herein, means that the component is contained in 50% by weight or more.

A substrate used in the present invention can be a multilayer structure. Here, it is essential that a side in which a Ni plating layer is to be formed, that is, the surface layer is made of a conductive metal, and other layers can be made of a conductive metal or a nonmetallic material such as ceramics and a resin, or alternatively a less conductive semimetallic material such as silicon. Herein, a semimetallic material refers to a material which exhibits certain conductivity but does not conductivity adequate to allow for ordinary electroplating.

Even with a nonmetallic material or semimetallic material, a conductive metal layer can be formed to its surface, to give a porous Ni plating layer of the present invention. Examples of a method for forming a conductive metal layer on a surface include nonelectrolytic plating, vapor deposition, sputtering, ion plating, cold spraying and aerosol deposition. Furthermore, application of a conductive paste or conductive polymer to a surface can be employed. Examples of a conductive metal include Ni, Cu, Al, Zn, Au, Ag, Cr, Ti, Sn, Pd, Ru and Rh, and alloys thereof can be also used. For example, a silicon wafer on whose surface a porous Ni plating layer is formed is suitable because it exhibits improved heat-dissipating ability from a semiconductor chip.

A cathode current density during electroplating a substrate is 10 A/dm$^2$ or more. Herein, a cathode current density refers to a value obtained by converting a current applied to a substrate (cathode) during electric Ni plating to a current per 1 dm$^2$ of the substrate. If a cathode current density is less than 10 A/dm$^2$, a uniform porous Ni plating layer cannot be formed. A cathode current density is preferably 12 A/dm$^2$ or more. There are no particular to the upper limit of a cathode current density, and a cathode current density is generally 1000 A/dm$^2$ or less, preferably 500 A/dm$^2$ or less, more preferably 300 A/dm$^2$ or less.

There are no particular restrictions to a plating time, and it can be appropriately selected such that a porous Ni plating layer with a desired thickness is formed. There are also no particular restrictions to a temperature of a plating solution. Since an excessively high temperature may cause alteration in a composition of a plating solution due to solvent evaporation, the temperature is generally 50° C. or lower.

Thus, a substrate can be immersed in the above plating solution and then electroplated under the above conditions, to provide a plated article in which a uniform porous Ni plating layer is formed over the whole surface.

It is preferable that a mean diameter of pores formed in the porous Ni plating layer thus formed is 1 to 300 μm as an area weighted average value. If the mean diameter is less than 1 μm, a corrosion current cannot be dispersed even when a porous Ni plating layer is formed on a substrate aiming at improving corrosion resistance of the plated article, so that corrosion resistance may not be improved. A mean diameter of pores is more preferably 5 μm or more, further preferably 10 μm or more. If a mean diameter of pores is more than 300 μm, strength of a porous Ni plating layer may be reduced, and thus it is preferably 200 μm or less. When a plated article is used as an electrical contact, a contact electric resistance may increase, leading to deterioration in electric conductivity. In this light, a mean diameter of pores is preferably 100 μm or less, more preferably 50 μm or less, further preferably 30 μm or less. Here, a mean diameter of pores can be determined by choosing multiple pores in a scanning electron microgram (secondary electron image) or microgram of the surface of the plated article, measuring their diameters and calculating an area load average thereof. When the pores are not circular, an equivalent circle diameter is regarded as a diameter.

A plated article produced by a producing method of the present invention can be used as a heat sink because it exhibits good heat-dissipating ability, and can be used as an electric part such as a connector because it has a low contact electric resistance and is excellent in corrosion resistance and sliding properties. With a high regard for heat-dissipating ability, a larger mean diameter of pores formed in the porous Ni plating layer is more preferable. With a high regard for contact electric resistance, corrosion resistance and sliding properties, a smaller mean diameter of pores formed in the porous Ni plating layer is more preferable. In a producing method of the present invention, a pore diameter of the porous Ni plating layer can be controlled by adding a water-soluble polymer or surfactant to a plating solution.

When it is desirable to increase a mean diameter of pores formed in a porous Ni plating layer, a plating solution preferably contains a water-soluble polymer. As is apparent from Examples below, when a plating solution contains a water-soluble polymer, a mean diameter of pores formed in a porous Ni plating layer is larger than that for a plating solution free from a water-soluble polymer. A content of the water-soluble polymer is preferably 0.01 to 5 g/L. If a content of the water-soluble polymer is less than 0.01 g/L, addition of the water-soluble polymer may be insufficiently effective. A content of the water-soluble polymer is more preferably 0.05 g/L or more. If a content of the water-soluble polymer is more than 5 g/L, a uniform porous Ni plating layer may not be formed. A content of the water-soluble polymer is more preferably 2 g/L or less, further preferably 1 g/L or less.

At this time, the reason why addition of a water-soluble polymer to a plating solution causes such a phenomenon is not exactly understood. It would be supposed that the water-soluble polymer acts as a thickener to make the plating solution viscous, which affects the plating reaction. Herein, a viscosity of the plating solution is preferably 1.1-fold or more, more preferably 1.2-fold or more of a viscosity (mPa·s) before addition of the water-soluble polymer.

There are no particular restrictions to the type of a water-soluble polymer, and a water-soluble polymer having hydroxy groups, carboxyl groups or the like can be mentioned. In the light of forming a uniform porous Ni plating layer, a polymer having carboxyl groups such as polyacrylic acid is suitable.

On the other hand, when it is desirable to reduce a mean diameter of pores formed in a porous Ni plating layer, a plating solution preferably contains a surfactant. In particular, the surfactant is more preferably an anionic or amphotic surfactant. As is apparent from Examples below, when a plating solution contains a surfactant, a mean diameter of pores formed in a porous Ni plating layer is smaller than that for a plating solution free from a surfactant. A content of the surfactant is preferably 0.1 to 100 mg/L. If a content of the surfactant is less than 0.1 mg/L, addition of the surfactant may be insufficiently effective. A content of the surfactant is more preferably 0.2 mg/L or more. If a content of the surfactant is more than 100 mg/L, a uniform porous Ni plating layer may not be formed. A content of the surfactant is more preferably 50 mg/L or less.

A thickness of the porous Ni plating layer is preferably 1 to 300 μm. If the thickness is less than 1 μm, a porous Ni plating layer is so brittle that it may tend to be peeled off from a substrate. Furthermore, if the thickness is less than 1 μm, heat-dissipating ability may be insufficiently improved even when a porous Ni plating layer is formed on a substrate aiming at producing a plated article with high heat-dissipating ability. A thickness of the porous Ni plating layer is more preferably 5 μm or more, further preferably 10 μm or more, particularly preferably 20 μm or more. If a thickness of the porous Ni plating layer is more than 300 μm, a production cost may be increased. Here, a thickness of the porous Ni plating layer refers to a thickness from the substrate surface to a convex portion in the porous plating layer.

As described above, a uniform porous Ni plating layer can be formed on the whole surface of a substrate by electric Ni plating with a high current density. When a porous Ni plating layer is formed on a substrate by electroplating under such plating conditions, a plating solution containing 0.01 to 1 mol/L of Ni ions, 0.2 to 30 mol/L of ammonia, and 0.2 to 10 mol/L of at least one type of ions selected from the group consisting of ammonium ions and alkali metal ions, wherein a molar ratio of ammonia to Ni ions ($NH_3$/Ni ions) is 1 or more and a pH is 6 or more, is suitably used. Here, the plating solution can contain a water-soluble polymer or surfactant. The types and contents of these in plating solution and effects thereof are as described above.

According to a producing method of the present invention, a plated article in which a uniform porous Ni plating layer is formed on a substrate surface can be easily obtained. A plated article produced by a producing method of the present invention is excellent in electric, mechanical and chemical properties, so that it can be used in various applications. Specifically, a plated article thus produced can be used as an electric part such as a connector because it exhibits low contact electrical resistance and excellent corrosion resistance and slidability; can be used as an electrode such as an electrode for hydrogen generation because it is very porous and has a large surface area; and can be used as a heat sink because it exhibits good heat dissipation performance.

EXAMPLES

There will be further detailed the present invention with reference to, but not limited to, Examples.

Example 1

(Preparation of a Ni Plating Solution)

The following compounds were dissolved in ion-exchanged water. Concentrations were as described below.

Nickel chloride [$NiCl_2.6H_2O$]: 0.1 M (mol/L)

Ammonium chloride [$NH_4Cl$]: 2.0 M (mol/L)

To the aqueous solution thus prepared, a 28% by mass aqueous ammonia was added to prepare a Ni plating solution with a pH of 8.5. Here, an ammonia concentration per 1 liter of the plating solution was calculated from the molar number of ammonia added to the plating solution, and was 0.98 M.

(Electrolytic Degreasing)

A copper plate with a size of 20 mm×20 mm×0.3 mm was prepared as a substrate and immersed in a 50 g/L aqueous solution of an electrolytic degreaser "PAKUNA THE-210" from Yuken Industry Co., Ltd. at 50° C. Using the copper plate as a cathode, current was applied at a cathode current density of 5 A/dm$^2$ for 60 sec for degreasing. The degreased substrate was washed three times with ion-exchanged water, and then washed with an acid by immersing it in a 10 vol % aqueous solution of sulfuric acid at room temperature for 60 sec. Subsequently, again, it was washed three times with water.

(Forming of a Ni Plating Layer)

The electrolytically degreased substrate was immersed in the above Ni plating solution kept at 30° C. Then, with air-stirring, it was subjected to electric Ni plating at a cathode current density of 30 A/dm$^2$ for 300 sec. Then, the substrate was washed three times with ion-exchanged water and immersed in an aqueous solution of sodium hydroxide (50 g/L) at 50° C. for 60 sec. Subsequently, the substrate was washed three times with ion-exchanged water, immersed in ion-exchanged water at 50° C., and sonicated for 60 sec, to give a plated article. A thickness of the Ni plating layer was about 50 μm.

(Evaluation of a Ni Plating Layer)

(1) Surface Observation

Using a field-emission-type scanning electron microscope (FE-SEM) "S-4800" from Hitachi High-Technologies Corporation, a photo of the surface of the plated article was taken to give a secondary electron image. The secondary electron image obtained is shown in FIG. 1.

Then the secondary electron image of the plated article obtained was visually observed and evaluated in accordance with the following evaluation criteria. The results are shown in Table 1.

A: A uniform porous Ni plating layer was formed on the whole surface of the substrate.

B: A porous Ni plating layer was formed only on a part of the substrate.

C: A porous Ni plating layer was not formed.

(2) Pore Size

Multiple pores were chosen from a secondary electron image of the plated article obtained, and their diameters were measured and an area load average thereof was calculated. When the pores were not circular, an equivalent circle diameter was regarded as a diameter. The results are shown in Table 1.

Example 2

A Ni plating layer was formed on a substrate as described in Example 1, except that a pH of a Ni plating solution was changed as shown in Table 1. A thickness of the Ni plating layer was about 50 μm. Then, the Ni plating layer was evaluated as described in Example 1. The results are shown in Table 1.

Examples 3 to 7

Ni plating layers were formed on a substrate as described in Example 1, except that a cathode current density was changed as shown in Table 1. A thickness of the Ni plating layer was about 50 μm. Then, the Ni plating layer was evaluated as described in Example 1. The results are shown in Table 1.

Comparative Examples 1 and 2

Ni plating layers were formed on a substrate as described in Example 1, except that a pH or a cathode current density was changed as shown in Table 1. Then, the Ni plating layer was evaluated as described in Example 1. The results are shown in Table 1. FIG. 2 shows a secondary electron image of the surface of the plated article in Comparative Example 1.

Comparative Example 3

A Ni plating solution was prepared as described in Example 1, except that a nickel chloride concentration in the Ni plating solution was 0.2 M and a pH was not adjusted with aqueous ammonia. A pH of the Ni plating solution was 3.5. Then, a Ni plating layer was formed on a substrate as described in Example 1, except that a cathode current density was as shown in Table 1, and the Ni plating layer was evaluated. The results are shown in Table 1. FIG. 3 shows a secondary electron image of the surface of the plated article in Comparative Example 3.

TABLE 1

| | Plating solution | | Plating conditions | | Evaluation | |
|---|---|---|---|---|---|---|
| | pH of a plating solution | Ammonia content (M) | Cathode current density ($A/dm^2$) | Plating time (sec) | Surface observation | Pore size (μm) |
| Example 1 | 8.5 | 0.98 | 30 | 300 | A | 14 |
| Example 2 | 7.5 | 0.33 | 30 | 300 | A | 22 |
| Example 3 | 8.5 | 0.98 | 15 | 300 | A | 13 |
| Example 4 | 8.5 | 0.98 | 18 | 300 | A | 15 |
| Example 5 | 8.5 | 0.98 | 20 | 300 | A | 12 |
| Example 6 | 8.5 | 0.98 | 25 | 300 | A | 12 |
| Example 7 | 8.5 | 0.98 | 35 | 300 | A | 18 |
| Comparative Example 1 | 5.0 | 0.03 | 30 | 300 | B | 16 |
| Comparative Example 2 | 8.5 | 0.98 | 8 | 300 | B | 16 |
| Comparative Example 3 | 3.5 | 0 | 25 | 300 | B | 26 |

As shown in Table 1, in a plated article produced by a producing method of the present invention, a uniform porous Ni plating layer was formed on the whole surface of a substrate (Examples 1 to 7). In contrast, in a plated article produced by a producing method which does not meet the conditions defined in the present invention, a porous Ni plating layer was formed only on a part of the substrate, but a uniform porous Ni plating layer was not formed on the whole surface of the substrate (Comparative Examples 1 to 3).

Example 8

A Ni plating layer was formed on a substrate as described in Example 1, substituting a plating solution prepared as described below for the plating solution used in Example 1. A thickness of the Ni plating layer was about 50 μm. Then, the Ni plating layer was evaluated as described in Example 1. The results are shown in Table 2.

(Preparation of a Ni Plating Solution)

The following compounds were dissolved in ion-exchanged water. Concentrations were as described below. A viscosity of the plating solution was 1.8 mPa·s.

Nickel sulfate [$NiSO_4.6H_2O$]: 0.15 M

Nickel chloride [$NiCl_2.6H_2O$]: 0.05 M

Ammonium sulfate [$(NH_4)_2SO_4$]: 1.0 M

To the aqueous solution thus prepared, a 28% by mass aqueous ammonia was added to prepare a Ni plating solution with a pH of 8.5. Here, an ammonia concentration per 1 liter of the plating solution was calculated from the molar number of ammonia added to the plating solution, and was 0.98 M.

Example 9

A Ni plating layer was formed on a substrate as described in Example 8, except that to the plating solution in Example 8, a carboxyvinyl polymer (Wako Pure Chemical Industries, Ltd., trade name "HIVISWAKO 105": cross-linking polyacrylic acid) as a water-soluble polymer was added to 0.1 g/L. A viscosity of the plating solution was 2 mPa·s. A thickness of the Ni plating layer thus obtained was about 50 μm. Then, the Ni plating layer was evaluated as described in Example 1. The results are shown in Table 2.

Example 10

A Ni plating layer was formed on a substrate as described in Example 8, except that to the plating solution in Example 8, a water-soluble polymer (Wako Pure Chemical Industries, Ltd., trade name "HIVISWAKO 105") was added to 0.3 g/L. A viscosity of the plating solution was 2.4 mPa·s. A thickness of the Ni plating layer thus obtained was about 50 μm. Then, the Ni plating layer was evaluated as described in Example 1. The results are shown in Table 2.

Example 11

A Ni plating layer was formed on a substrate as described in Example 8, except that a plating time was changed to 600 sec. A thickness of the Ni plating layer thus obtained was about 100 μm. Then, the Ni plating layer was evaluated as described in Example 1. The results are shown in Table 2.

Example 12

A Ni plating layer was formed on a substrate as described in Example 8, except that to the plating solution in Example 8, a water-soluble polymer (Wako Pure Chemical Industries, Ltd., trade name "HIVISWAKO 105") was added to 0.1 g/L and a plating time was changed to 600 sec. A thickness of the Ni plating layer thus obtained was about 100 μm. Then, the Ni plating layer was evaluated as described in Example 1. The results are shown in Table 2. Furthermore, the surface of the plated article was observed using a microscope. The microgram obtained is shown in FIG. 4.

Example 13

A Ni plating layer was formed on a substrate as described in Example 8, except that to the plating solution in Example 8, a water-soluble polymer (Wako Pure Chemical Industries, Ltd., trade name "HIVISWAKO 105") was added to 0.3 g/L and a plating time was changed to 600 sec. A thickness of the Ni plating layer thus obtained was about 100 μm. Then, the Ni plating layer was evaluated as described in Example 1. The results are shown in Table 2.

Example 14

A Ni plating layer was formed on a substrate as described in Example 8, except that to the plating solution in Example 8, an anionic surfactant (AGC Seimi Chemical Co., Ltd., trade name "SURFLON S-211") was added to 1 mg/L. A thickness of the Ni plating layer was about 50 μm. Then, the Ni plating layer was evaluated as described in Example 1. The results are shown in Table 2.

Example 15

A Ni plating layer was formed on a substrate as described in Example 14, except that the amount of the anionic surfactant was changed to 5 mg/L. A thickness of the Ni plating layer was about 50 μm. Then, the Ni plating layer was evaluated as described in Example 1. The results are shown in Table 2.

Example 16

A Ni plating layer was formed on a substrate as described in Example 14, except that the amount of the anionic surfactant was changed to 10 mg/L. A thickness of the Ni plating layer was about 50 μm. Then, the Ni plating layer was evaluated as described in Example 1. The results are shown in Table 2.

Example 17

A Ni plating layer was formed on a substrate as described in Example 8, except that to the plating solution in Example 8, an ampholytic surfactant (AGC Seimi Chemical Co., Ltd., trade name "SURFLON S-231") was added to 1 mg/L. A thickness of the Ni plating layer was about 50 μm. Then, the Ni plating layer was evaluated as described in Example 1. The results are shown in Table 2.

Example 18

A Ni plating layer was formed on a substrate as described in Example 17, except that the amount of the ampholytic surfactant was changed to 5 mg/L. A thickness of the Ni plating layer was about 50 μm. Then, the Ni plating layer was evaluated as described in Example 1. The results are shown in Table 2.

Example 19

A Ni plating layer was formed on a substrate as described in Example 17, except that the amount of the ampholytic surfactant was changed to 10 mg/L. A thickness of the Ni plating layer was about 50 μm. Then, the Ni plating layer was evaluated as described in Example 1. The results are shown in Table 2.

Comparative Example 4

A Ni plating solution at pH 5.0 was prepared by adding 28% by mass aqueous ammonia to the solution of Example 8. However, precipitation occurred in the Ni plating solution prepared, so that plating could not be conducted.

Comparative Example 5

A Ni plating layer was formed on a substrate as described in Example 8, except that a cathode current density was changed as shown in Table 2. Then, the Ni plating layer was evaluated as described in Example 1. The results are shown in Table 2.

TABLE 2

| | Plating solution | | | | Plating conditions | | Evaluation | |
|---|---|---|---|---|---|---|---|---|
| | pH of a plating solution | Ammonia content (M) | Additive | Additive concentration | Cathode current density (A/dm$^2$) | Plating time (sec) | Surface observation | Pore size (μm) |
| Example 8 | 8.5 | 0.98 | None | — | 30 | 300 | A | 22 |
| Example 9 | 8.5 | 0.98 | Water-soluble polymer | 0.1*1 | 30 | 300 | A | 65 |
| Example 10 | 8.5 | 0.98 | Water-soluble polymer | 0.3*1 | 30 | 300 | A | 85 |
| Example 11 | 8.5 | 0.98 | None | — | 30 | 600 | A | 50 |
| Example 12 | 8.5 | 0.98 | Water-soluble polymer | 0.1*1 | 30 | 600 | A | 119 |
| Example 13 | 8.5 | 0.98 | Water-soluble polymer | 0.3*1 | 30 | 600 | A | 135 |
| Example 14 | 8.5 | 0.98 | Anionic surfactant | 1*2 | 30 | 300 | A | 20.2 |
| Example 15 | 8.5 | 0.98 | Anionic surfactant | 5*2 | 30 | 300 | A | 16.6 |
| Example 16 | 8.5 | 0.98 | Anionic surfactant | 10*2 | 30 | 300 | A | 13.9 |
| Example 17 | 8.5 | 0.98 | Amphoteric surfactant | 1*2 | 30 | 300 | A | 17.9 |
| Example 18 | 8.5 | 0.98 | Amphoteric surfactant | 5*2 | 30 | 300 | A | 14.8 |
| Example 19 | 8.5 | 0.98 | Amphoteric surfactant | 10*2 | 30 | 300 | A | 12.5 |
| Comparative Example 4 | 5.0 | 0 | None | — | *3 | *3 | *3 | *3 |
| Comparative Example 5 | 8.5 | 0.98 | None | — | 8 | 300 | B | 20 |

*1g/L

*2M g/L

*3Due to precipitation in a plating solution, plating was not done

As shown in Table 2, in a plated article produced by a producing method of the present invention, a uniform porous Ni plating layer was formed on the whole surface of a substrate (Example 8). When Ni plating was conducted with a plating solution containing a water-soluble polymer, a mean diameter of pores was increased (Examples 9, 10, 12 and 13), while when Ni plating was conducted with a plating solution containing an anionic surfactant or an ampholytic surfactant, a mean diameter of pores was reduced (Examples 14 to 19). In contrast, in a plated article produced by a producing method which does not meet the conditions defined in the present invention, a porous Ni plating layer was formed only on a part of the substrate, but a uniform porous Ni plating layer was not formed on the whole surface of the substrate (Comparative Example 5).

Example 20

A Ni plating layer was formed on a substrate as described in Example 1, substituting a plating solution prepared as described below for the plating solution used in Example 1. A thickness of the Ni plating layer was about 50 μm. Then, the Ni plating layer was evaluated as described in Example 1. The results are shown in Table 3.

(Preparation of a Ni Plating Solution)

The following compounds were dissolved in ion-exchanged water. Concentrations were as described below.

Nickel sulfamate [$Ni(NH_2SO_3)_2.4H_2O$]: 0.2 M

Ammonium sulfamate [$NH_4OSO_2NH_2.H_2O$]: 2.0 M

To the aqueous solution thus prepared, a 28% by mass aqueous ammonia was added to prepare a Ni plating solution with a pH of 8.5. Here, an ammonia concentration per 1 liter of the plating solution was calculated from the molar number of ammonia added to the plating solution, and was 1.8 M.

Comparative Example 6

A Ni plating layer was formed on a substrate as described in Example 20, except that a pH of a Ni plating solution was as shown in Table 3. Then, the Ni plating layer was evaluated as described in Example 1. The results are shown in Table 3.

Comparative Example 7

A Ni plating layer was formed on a substrate as described in Example 20, except that a cathode current density was as shown in Table 3. Then, the Ni plating layer was evaluated as described in Example 1. The results are shown in Table 3.

As shown in Table 3, in a plated article produced by a producing method of the present invention, a uniform porous Ni plating layer was formed on the whole surface of a substrate (Example 20). In contrast, in a plated article produced by a producing method which does not meet the conditions defined in the present invention, a porous Ni plating layer was formed only on a part of the substrate, but a uniform porous Ni plating layer was not formed on the whole surface of the substrate (Comparative Example 6). In particular, when a cathode current density is less than that defined in the present invention, a porous Ni plating layer was not formed (Comparative Example 7).

Example 21

A Ni plating layer was formed on a substrate as described in Example 1, substituting a plating solution prepared as described below for the plating solution used in Example 1. A thickness of the Ni plating layer was about 50 μm. Then, the Ni plating layer was evaluated as described in Example 1. The results are shown in Table 4.

(Preparation of a Ni Plating Solution)

The following compounds were dissolved in ion-exchanged water. Concentrations were as described below.

Nickel acetate [$Ni(CH_3COOH)_2.4H_2O$]: 0.2 M

Ammonium acetate [$CH_3COONH_4$]: 1.0 M

To the aqueous solution thus prepared, a 28% by mass aqueous ammonia was added to prepare a Ni plating solution with a pH of 8.5. Here, an ammonia concentration per 1 liter of the plating solution was calculated from the molar number of ammonia added to the plating solution, and was 1.97 M.

Comparative Example 8

A Ni plating solution was prepared as described in Example 21, except that a pH was not adjusted with aqueous ammonia. A pH of the Ni plating solution was 5.0. Then, a Ni plating layer was formed on a substrate and evaluated as described in Example 1. The results are shown in Table 4.

Comparative Example 9

A Ni plating layer was formed on a substrate as described in Example 21, except that a cathode current density was changed as shown in Table 4. Then, the Ni plating layer was evaluated as described in Example 1. The results are shown in Table 4.

TABLE 3

| | Plating solution | | Plating conditions | | Evaluation | |
|---|---|---|---|---|---|---|
| | pH of a plating solution | Ammonia content (M) | Cathode current density ($A/dm^2$) | Plating time (sec) | Surface observation | Pore size (μm) |
| Example 20 | 8.5 | 1.8 | 30 | 300 | A | 14 |
| Comparative Example 6 | 5.0 | 0.69 | 30 | 300 | B | 11 |
| Comparative Example 7 | 8.5 | 1.8 | 8 | 300 | C | — |

TABLE 4

| | Plating conditions | | Plating conditions | | Evaluation | |
|---|---|---|---|---|---|---|
| | pH of a plating solution | Ammonia content (M) | Cathode current density ($A/dm^2$) | Plating time (sec) | Surface observation | Pore size (μm) |
| Example 21 | 8.5 | 1.97 | 30 | 300 | A | 21 |
| Comparative Example 8 | 5.0 | 0 | 30 | 300 | B | 31 |
| Comparative Example 9 | 8.5 | 1.97 | 8 | 300 | B | 13 |

As shown in Table 4, in a plated article produced by a producing method of the present invention, a uniform porous Ni plating layer was formed on the whole surface of a substrate (Example 21). In contrast, in a plated article produced by a producing method which does not meet the conditions defined in the present invention, a porous Ni plating layer was formed only on a part of the substrate, but a uniform porous Ni plating layer was not formed on the whole surface of the substrate (Comparative Examples 8 and 9).

Example 22

An electroless Ni plating layer was formed on a silicon wafer to a thickness of 5 μm. Then, electric Ni plating was conducted as described in Example 1, to form a porous Ni plating layer on the surface of the electroless Ni plating layer. A thickness of the porous Ni plating layer was 100 μm. Observation of the surface of the silicon wafer demonstrated that a uniform porous Ni plating layer was formed on the whole surface. A mean diameter of pores was 22 μm.

The invention claimed is:

1. A method for producing a plated article, comprising immersing a substrate made of a conductive metal in a plating solution, and forming a plating layer on the substrate by electroplating, wherein the plating solution is a solution containing 0.01 to 1 mol/L of Ni ions with a pH of 7.5 or more; and a porous Ni plating layer is formed by performing the electroplating at a cathode current density of 10 $A/dm^2$ or more, wherein, the plating solution contains 0.2 to 30 mol/L of ammonia, and a molar ratio of ammonia to Ni ions ($NH_3$/Ni ions) is 1 or more, and wherein a mean diameter of pores formed in the porous Ni plating layer is 1 to 300 μm as an area weighted average value.

2. The method for producing as claimed in claim 1, wherein the plating solution contains 0.2 to 10 mol/L of at least one type of ions selected from the group consisting of ammonium ions and alkali metal ions.

3. The method for producing as claimed in claim 2, wherein the plating solution contains, as counter anions to Ni, ammonium and alkali metal ions, at least one type of ions selected from the group consisting of chloride, sulfate, sulfamate and acetate ions.

4. The method for producing as claimed in claim 1, wherein the plating solution contains 0.01 to 5 g/L of a water-soluble polymer.

5. The method for producing as claimed in claim 1, wherein the plating solution contains 0.1 to 100 mg/L of a surfactant.

6. The method for producing as claimed in claim 1, wherein a thickness of the porous Ni plating layer is 1 to 300 μm.

7. The method for producing as claimed in claim 1, wherein the substrate consists of a conductive metal layer formed on a surface of a nonmetallic or semimetallic material.

* * * * *